US006870933B2

(12) United States Patent
Roovers

(10) Patent No.: US 6,870,933 B2
(45) Date of Patent: Mar. 22, 2005

(54) STEREO AUDIO PROCESSING DEVICE FOR DERIVING AUXILIARY AUDIO SIGNALS, SUCH AS DIRECTION SENSING AND CENTER SIGNALS

(75) Inventor: David Antoine Christian Marie Roovers, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 616 days.

(21) Appl. No.: 09/906,934

(22) Filed: Jul. 17, 2001

(65) Prior Publication Data

US 2002/0031232 A1 Mar. 14, 2002

(30) Foreign Application Priority Data

Jul. 17, 2000 (EP) ..... 00202564

(51) Int. Cl.[7] ..... H04R 5/00
(52) U.S. Cl. ..... 381/27
(58) Field of Search ..... 381/27, 1, 19–23.1, 381/17, 18, 300–311; 367/110–127

(56) References Cited

U.S. PATENT DOCUMENTS 5,528,694 A 6/1996 Van De Kerkhof et al. .. 381/27
6,519,344 B1 * 2/2003 Yajima et al. ..... 381/103

FOREIGN PATENT DOCUMENTS

JP 06090500 3/1994 ..... H04S/5/02

OTHER PUBLICATIONS

Patent Abstracts of Japan, Yanagisawa Takaaki, "Sound Image Normal Position Controller," Publication No. 06090500, Mar. 29, 1994, Application No. 04265538, Sep. 9, 1992.

* cited by examiner

*Primary Examiner*—Forester W. Isen
*Assistant Examiner*—Corey Chau
(74) *Attorney, Agent, or Firm*—Edward W. Goodman

(57) ABSTRACT

An audio signal processing device is described for deriving auxiliary audio signals, such as audio direction sensing signals or a center audio signal from first and second audio signals through first and second filter paths, each of which comprises a first adaptive filter, and a first summing means is provided for coupled to the first adaptive filters for providing a summed audio signal at its summing output. Each filter path further comprises a second adaptive filter coupled to said summing output, whose respective adaptive filter coefficients are transferred to the first adaptive filters and are adapted in response to respective comparisons of the first and second audio signals with filtered sums of the first and second audio signals. Therewith correlated and uncorrelated parts of the input audio signals are processed effectively.

8 Claims, 1 Drawing Sheet

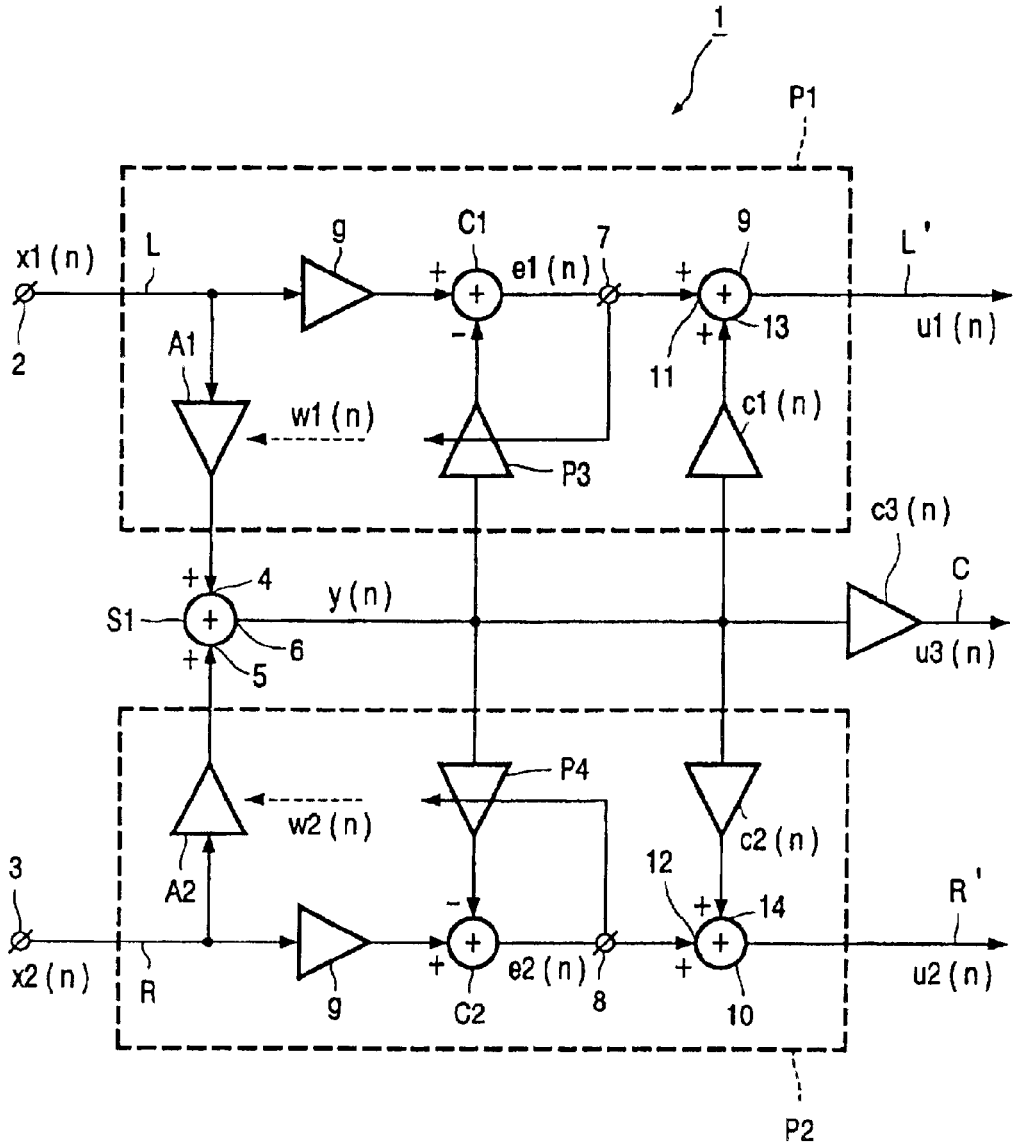
1
P1
x1 (n)
2
L
g
C1
e1 (n)
7
9
L'
u1 (n)
13
11
A1
w1 (n)
P3
c1 (n)
c3 (n)
C
u3 (n)
S1
4
y (n)
6
5
P4
w2 (n)
c2 (n)
3
A2
12
14
R'
x2 (n)
R
9
C2
e2 (n)
8
10
u2 (n)
P2

STEREO AUDIO PROCESSING DEVICE FOR DERIVING AUXILIARY AUDIO SIGNALS, SUCH AS DIRECTION SENSING AND CENTER SIGNALS

The present invention relates to an audio signal processing device for deriving auxiliary audio signals from first and second audio signals through first and second filter paths, each of which comprises a first adaptive filter, and a first summing means is provided which is coupled to the first adaptive filters for providing a summed audio signal at its summing output.

In addition the present invention relates to an audio signal processing device for deriving a centre audio signal from first and second audio signals through first and second filter paths, each of which comprises a first adaptive filter, and a first summing means is provided which is coupled to the first adaptive filters for providing a summed audio signal at its summing output.

The present invention also relates to a microprocessor suitably programmed for application in the audio processing device, and to an either or not hands-free audio device, such as a tuner, radio receiver, audio recording device, audio visual device and the like, comprising such an audio processing device.

Such an audio processing device is known from applicants own patent U.S. Pat. No. 5,528,694. The known audio processing device derives an audio centre signal from left and right stereo audio signals. The known device comprises a two output splitter circuit having a first filter path and a second filter path. Each of the filter paths has an adaptive filter, whose outputs are coupled to the two outputs of the splitter circuit. Each of the adaptive filters has respective adjusting circuits for adjusting coefficients of the filters. The coefficients of the adaptive filter in the first path are adapted in dependence on a comparison between the right audio signal and the output signal of the adaptive filter in the first path. Conversely the coefficients of the adaptive filter in the second path are adapted in dependence on a comparison between the left audio signal and the output signal of the adaptive filter in the second path. Finally the two outputs of the splitter circuit are being summed in a summing means which provides the audio centre signal at its summing output. There is in practice a need to further develop audio signal processing devices and the techniques applied therein, such that their application possibilities are widened.

Therefore it is an object of the present invention to provide a further developed audio signal processing device providing a plurality of auxiliary audio signals, such as direction sensing signals, which device is capable of being implemented efficiently and at relative low cost with a common fixed point digital signal processor, without the danger of numerical underflows or overflows.

Thereto the audio signal processing device according to the invention is characterised in that each filter path further comprises a second adaptive filter coupled to said summing output, whose respective adaptive filter coefficients are transferred to the first adaptive filters and are adapted in response to respective comparisons of the first and second audio signals with filtered sums of the first and second audio signals for deriving the auxiliary audio signals which provide audio direction sensing information.

Thereto in addition the audio signal processing device according to the invention is characterised in that each filter path further comprises a second adaptive filter coupled to said summing output, whose respective second adaptive filter coefficients are transferred to the first adaptive filters and are adapted in response to respective comparisons of the first and second audio signals with filtered sums of the first and second audio signals.

It is an advantage of the audio signal processing device according to the present invention that it provides in a simply to implement and broadly practically applicable direction sensing algorithm, which in an additional embodiment may at wish concentrate the correlated part of the first and second—in particular the left and right—audio signals in a centre part—generally the dominant part—of the stereophonic perception. Accordingly the uncorrelated parts may form the processed left and right audio signals. Furthermore because the direction sensing algorithm applied minimises, however limits, used control signals in its implementation this implementation is possible at relative low cost with a common fixed point digital signal processor, without the danger of numerical underflows or overflows.

An embodiment of the audio processing device according to the invention is characterised in that each of the filter paths comprises a comparison means for providing respective audio signals to a positive input of said comparison means, whereby a negative input of said comparison means is coupled to an output of the respective second adaptive filters. Advantageously this decoder scheme for deriving a three channel stereo signal from a two channel stereo signal does not contain delay elements, which may jeopardise control stability of the applied algorithm.

A further embodiment of the audio processing device according to the invention is characterised in that each of the filter paths comprises second summing means having a first input coupled to an output of the comparison means, and having a second input coupled to the summing output of the first summing means for providing the respective first and second audio signals. This embodiment provides a full three stereo audio signal arrangement where to the two outer loudspeakers may be designated the uncorrelated audio components, which can be distributed over the outer loudspeakers to maintain a wide sound perception, whereas for example to a centre loudspeaker the correlated audio components may be designated. At wish another distribution or designation of audio components over several loudspeakers may be chosen.

A preferred simple embodiment the audio processing device according to the invention is characterised in that the comparison means are easy to integrate and implement subtracting means.

Accordingly the microprocessor according to the invention is characterised in that the microprocessor is suitably programmed for application in the aforementioned audio processing device, whereby the microprocessor is capable of calculating the second adaptive filter coefficients such that at least the correlated part of the first and second audio signals is included in the summed audio signal.

At present the audio processing device, microprocessor and audio device according to the invention will be elucidated further together with their additional advantages while reference is being made to the appended drawing. In the single drawing it is shown a preferred combination of possible embodiments of the audio processing device according to the present invention.

The FIGURE shows a audio processing device 1 in the form of a possible three channel decoder, wherein from first and second stereophonic audio signals viz. a left channel signal L and a right channel signal R are processed such in the audio processing device 1 that a processed left channel signal L, right channel signal R and centre channel signal C result. The FIGURE shows the processing steps to implement by a suitably programmed microprocessor (not shown) in order to achieve that result.

Digital samples x1(n) and x2(n), usually in the form of digital sampling blocks are input on the left of the FIGURE on input terminals 2 and 3 of the device 1. The left and right signals L and R respectively are applied to first and second filter paths schematically indicated by P1 and P2 respectively. Each of the filter paths P1 and P2 comprises a first adaptive filter A1 and A2 coupled to the input terminals 2 and 3 respectively and a first summing means S1 having positive inputs 4 and 5 coupled to the filters A1 and A2. At an output 6 of the summing means S1 a summed audio signal y(n) is provided. The adaptive filters A1 and A2 may for example be adaptive simple scaling means, or well known FIR filters. The means or filters A1 and A2 have adjustable scaling/filter coefficients w1(n) and w2(n) respectively.

Each filter path P1, P2 further comprises a second adaptive scaling means or filter P3, P4 coupled to summing output 6 of the summing means S1. The same respective adaptive scaling or filter coefficients w1(n) and w2(n) of the filters P3, P4 are also transferred to the first adaptive means or filters P1, P2. Through generally gain or filter means g the input signals L and R are led to comparison means C1 and C2. The adaptive coefficients are adapted in response to respective comparisons of the first and second audio signals gx1(n) and gx2(n) with adaptively filtered sums of the first and second audio signals, embodied by the summed audio signal y(n). The comparison may be implemented by an algorithm, wherein the individual output signals e1(n) and e2(n) of the comparison means C1 and C2 are minimised. Thereto the filter coefficients w1(n) and w2(n) are adapted accordingly. The signal y(n) generally is a weighted sum according to: y(n)=w1(n)x1(n)+w2(n)x2(n) carrying most of the audio signal energy, and is therefore called the dominant signal. Further details of the functioning of the audio processing device 1 may be found in applicants EP-A-0954850 (=WO9927522), whose relevant disclosure is included here by reference thereto.

The reference above does however not teach the use of the adapted output signals e1 and e2 for providing the adapted coefficients w1 and w2 as wanted direction sensing signals. Nor does the reference disclose the use of these direction sensing signals in a three channel decoder implemented in the sole FIGURE. The result of the direction sensing algorithm applied in the diagram of the FIGURE may be that the summed audio signal y(n) may at least comprise the correlated part of the stereophonic left and right audio signals, whereas the processed left and right audio signals on output terminals 7 and 8 may at wish contain the uncorrelated parts of the original stereophonic signals. In general the summed audio signal y(n) may also comprise some uncorrelated parts or components of the stereophonic signals.

The comparison means C1 and C2 mentioned above may be simple subtracting means each having a positive input+ coupled to the left and right audio input signals respectively and a negative input−coupled to the second adaptive filters P3, P4 respectively. In addition each of the filter paths P1, P2 comprises second summing means 9, 10 having first inputs 11, 12 coupled to the output signal e1(n) and e2(n) of the comparison means C1 and C2, and having second inputs 13, 14 coupled to the summing output signal y(n) provided by the first summing means S1 for providing the processed left and right audio signals. The summing output signal y(n) will generally be supplied through amplifiers/attenuaters having coefficients c1(n), c2(n), and c3(n) in order to distribute the processed audio signals over the loudspeakers for maintaining a wide sound distribution.

Some further background information will now be given on the subject at hand. A common technique for controlling localisation in stereophonic sound reproduction is called amplitude encoding (also called panning). This technique is based on the fact that the localisation of a phantom source in a stereophonic set-up is largely determined by the amplitude ratio between left and right audio channels. In a mixing studio this amplitude ratio is manipulated in order to achieve a desired source localisation by a listener. Another quantity of interest in stereophonic sound reproduction is the correlation coefficient between the left and right audio input signals L and R. A high correlation coefficient generally results in a well localised phantom source, whereas a low correlation coefficient generally results in a wide, hardly localisable sound source.

In certain applications it is desirable to modify and/or control the stereophonic sound after it is recorded. This is the case in, for example, multichannel decoders, which aim at reproducing the sound using a larger number of loudspeakers than the number of recorded channels. Such systems generally consist of two stages: an analysis stage and a matrix stage. In the analysis stage time varying signal characteristics such as the aforementioned amplitude ratio and correlation coefficient are determined and control signals are generated in accordance with these characteristics. In the matrix stage these control signals are used to control the coefficients of a matrix which is used to convert input signals into output signals. The audio signal processing device 1 may be used for such an analysis stage. Reference is again made to EP-A-0954850 for further details.

In a practical embodiment the coefficients c1(n), c2(n), and c3(n) generally are functions of the weights w1 and w2 and of a time averaged correlation measure p of the audio input signals L and R. In a further embodiment the functions are for example chosen such that the following requirements are met:

When there is no correlation between the input signals and they have equal variance, the left and right loudspeakers should receive the unprocessed input signals and the centre loudspeaker should have zero input. In this way, a maximally wide soundstage is maintained in case of uncorrelated input signals;

When the input signals are perfectly correlated, the retrieved summing output signal y(n) should be distributed over either the left and centre loudspeaker or the right and centre loudspeaker depending on the intended location. This procedure is commonly referred as pairwise panning.

In between these extremes, the perceived sound should be close to the intended original and all transitions should be smooth.

This functionality can be implemented with g=1, whereby the comparison means C1 and C2 are subtracting means, whereas the following equations are being used.

Let:

$$b_1 = w_1^2 - w_2^2$$

$$b_2 = 2w_1 w_2$$

if $b_2 < 0$, then let $$c_1 = c_2 = c_3 = 0$$

else if $b_1 < 0$, then let

-continued $$c_1 = -\rho(|w_1| + b_1)$$

$$c_2 = -\rho|w_2|$$

$$c_3 = \rho b_2$$

else let $$c_1 = -\rho|w_1|$$

$$c_2 = -\rho(|w_1| - b1)$$

$$c_3 = \rho b_2.$$

As stated above this implemented decoding algorithm is only one example of the many applications of the presented direction sensing functionality of the present audio processing device 1. In another possible implementing embodiment the algorithm may be applied in separate and independent frequency bands or bins by using filter banks.

Whilst the above has been described with reference to essentially preferred embodiments and best possible modes it will be understood that these embodiments are by no means to be construed as limiting examples of the devices concerned, because various modifications, features and combination of features falling within the scope of the appended claims are now within reach of the skilled person, as explained in the above.

What is claimed is:

1. An audio signal processing device for deriving auxiliary audio signals from first and second audio signals, said audio signal processing device comprising:

first and second filter paths for receiving said first and second audio signals, respectively, said first and second filter paths each comprising a first adaptive filter; and a first summing means coupled to respective outputs of the first adaptive filters, said first summing means having a summing output for providing a summed audio signal, characterized in that each filter path further comprises a second adaptive filter coupled to said summing output having respective adaptive filter coefficients which are transferred to the first adaptive filters, said respective adaptive filter coefficients being adapted in response to respective comparisons of the first and second audio signals with filtered versions of the summed audio signal for deriving the auxiliary audio signals, said auxiliary audio signals providing audio direction sensing information.

2. An audio signal processing device for deriving a center audio signal from first and second audio signals, said audio signal processing device comprising:

first and second filter paths each comprising a first adaptive filter; and a first summing means coupled to the first adaptive filters for providing a summed audio signal, characterized in that each of said first and second filter paths further comprises a second adaptive filter coupled to an output of said first summing means for receiving said summed audio signal, said second adaptive filters having respective adaptive filter coefficients which are transferred to the first adaptive filters, said respective adaptive filter coefficients being adapted in response to respective comparisons of the first and second audio signals with filtered versions of the summed audio signal.

3. The audio signal processing device as claimed in claim 1, characterized in that each of the first and second filter paths comprises a comparison means having a positive input (+) for receiving said first and second audio signals, respectively, and a negative input (−) coupled to an output of the respective second adaptive filters.

4. The audio signal processing device as claimed in claim 3, characterized in that each of the first and second filter paths comprises second summing means having a first input coupled to an output of respective comparison means, and a second input coupled to the summing output of the first summing means, said second summing means having respective outputs for providing respective first and second output audio signals.

5. The audio signal processing device as claimed in claim 3, characterized in that each of the comparison means comprises subtracting means.

6. The audio signal processing device as claimed in claim 4, characterized in that the summing output of said first summing means is coupled to a loudspeaker for sound reproduction of a center audio signal, and said second summing means are coupled to respective loudspeakers for sound reproduction of left and right audio signals, respectively.

7. A microprocessor suitably programmed for application in the audio signal processing device as claimed in claim 1, characterized in that the microprocessor is programmed to calculate the respective adaptive filter coefficients of the second adaptive filters such that at least a correlated part of the first and second audio input signals is included in the summed audio signal.

8. An audio device comprising an audio signal processing device for deriving auxiliary audio signals from first and second audio signals, said audio signal processing device comprising:

first and second filter paths for receiving said first and second audio signals, respectively, said first and second filter paths each comprising a first adaptive filter; and a first summing means coupled to respective outputs of the first adaptive filters, said first summing means having a summing output for providing a summed audio signal, characterized in that each filter path further comprises a second adaptive filter coupled to said summing output having respective adaptive filter coefficients which are transferred to the first adaptive filters, said respective adaptive filter coefficients being adapted in response to respective comparisons of the first and second audio signals with filtered versions of the summed audio signal for deriving the auxiliary audio signals, said auxiliary audio signals providing audio direction sensing information, wherein said audio device further comprises a microprocessor suitably programmed for application in the audio signal processing device, said microprocessor being programmed to calculate the respective adaptive filter coefficients of the second adaptive filters such that at least a correlated part of the first and second audio input signals is included in the summed audio signal.

* * * * *